US010768647B2

(12) United States Patent
Vareljian et al.

(10) Patent No.: US 10,768,647 B2
(45) Date of Patent: Sep. 8, 2020

(54) REGULATORS WITH LOAD-INSENSITIVE COMPENSATION

(71) Applicant: Atmel Corporation, San Jose, CA (US)

(72) Inventors: Albert Vareljian, Folsom, CA (US); Ronak Desai, San Jose, CA (US); Bilin Wang, San Jose, CA (US)

(73) Assignee: Atmel Corporation, San Jose, CA (US)

( * ) Notice: Subject to any disclaimer, the term of this patent is extended or adjusted under 35 U.S.C. 154(b) by 0 days.

(21) Appl. No.: 15/190,878

(22) Filed: Jun. 23, 2016

(65) Prior Publication Data

US 2017/0371364 A1 Dec. 28, 2017

(51) Int. Cl.

| | |
|---|---|
| ***G05F 1/575*** | (2006.01) |
| *G05F 1/46* | (2006.01) |
| *G05F 1/59* | (2006.01) |
| *G05F 1/26* | (2006.01) |

(52) U.S. Cl.

CPC ..... *G05F 1/575* (2013.01); *G05F 1/26* (2013.01); *G05F 1/461* (2013.01); *G05F 1/59* (2013.01)

(58) Field of Classification Search

CPC . G05F 1/565; G05F 1/575; G05F 1/59; G05F 3/26; G05F 1/461; H02M 7/04

See application file for complete search history.

(56) References Cited

U.S. PATENT DOCUMENTS 4,415,868 A * 11/1983 Gross ..... H03F 1/083 330/107
6,201,442 B1 * 3/2001 James ..... H03F 1/083 330/107
6,536,578 B1 * 3/2003 Ashley ..... G07D 5/08 194/318
8,294,441 B2 10/2012 Gurcan et al.
2004/0227497 A1 * 11/2004 Asanuma ..... G05F 1/575 323/283
2005/0024908 A1 * 2/2005 Gizara ..... H02M 3/00 363/147
2006/0164053 A1 * 7/2006 Walter ..... G05F 1/575 323/282
2012/0069680 A1 * 3/2012 Goda ..... G11C 16/10 365/185.23
2014/0232465 A1 * 8/2014 Yan ..... H03F 3/45192 330/260
2017/0115678 A1 * 4/2017 Qing ..... G05F 1/575
2017/0194908 A1 * 7/2017 Madala ..... H03B 5/1212

OTHER PUBLICATIONS

Specification Sheet—Texas Instruments Technical Document (Data Sheet)—LF155, LF156, LF256, LF257 LF355, LF356, LF357, May 2000,Texas Instruments Inc., Author is Texas Instrument.*

* cited by examiner

*Primary Examiner* — Shawki S Ismail
*Assistant Examiner* — Demetries A Gibson
(74) *Attorney, Agent, or Firm* — Fish & Richardson P.C.

(57) ABSTRACT

Systems, methods, circuits and computer-readable mediums for regulators, e.g., low-dropout (LDO) regulators, with load-insensitive compensations are provided. An example regulator includes an amplifier operable to receive an input voltage and a feedback voltage, a follower responsive to an output voltage of the amplifier and operable to supply a regulated voltage to a load coupled to the follower, and a feedback circuit coupled to the load and the amplifier and operable to provide the feedback voltage. The amplifier is operable to have a substantially unity gain beyond a resonant frequency of the amplifier.

20 Claims, 12 Drawing Sheets

REGULATORS WITH LOAD-INSENSITIVE COMPENSATION

TECHNICAL FIELD

This disclosure relates generally to circuitry, particularly to regulators.

BACKGROUND

Large variations in capacitive and/or current loading conditions of amplifiers or regulators, e.g., low-dropout (LDO) regulators, typically result in loss of stability in a close-loop system, which causes unwanted oscillations at an output and thus failure of functionality. In one exemplary application such as back-bias drivers used to reduce a chip overall power consumption, the loading conditions may not be rigidly defined upfront and could vary several orders of magnitude over the chip operating modes. Under such conditions implementation of compensation schemes reliant on a feedback loop pole-zero movement becomes problematic. In some cases, methods are implemented by tracking and compensating unwanted (e.g., high-order) poles in a loop transfer function by corresponding introduced zeros in a certain frequency range, so as to maintain a sufficient close-loop phase margin to avoid negative feedback turning positive where loop gain is greater than unity. However, such methods may become ineffective where the close-loop system parasitic pole variability is either too large or not known upfront, or is difficult to constrain.

SUMMARY

This specification describes systems, methods, circuits and computer-readable mediums for regulators, e.g., low dropout regulators, with load-insensitive compensations. In one embodiment, a regulator includes an amplifier operable to receive an input voltage and a feedback voltage, a follower responsive to an output voltage of the amplifier and operable to supply a regulated voltage to a load coupled to the follower, and a feedback circuit coupled to the load and the amplifier and operable to provide the feedback voltage. The amplifier is operable to have a substantially unity gain beyond a resonant frequency of the amplifier.

The details of one or more disclosed implementations are set forth in the accompanying drawings and the description below. Other features, aspects, and advantages will become apparent from the description, the drawings and the claims.

DETAILED DESCRIPTION

The description that follows is an example system that includes a regulator, e.g., a low dropout (LDO) regulator. The regulator implements a compensation scheme such that the regulator has a substantially unity gain beyond a resonant frequency of the regulator. The disclosed implementations can be adapted to any compensation system, e.g., an amplifier with feedback or a back-bias driver, which can maintain its stable operation over a large range of loading conditions and/or significant process, voltage, and temperature (PVT) variations, and/or with low quiescent consumption.

Example Regulators

Figure 1:
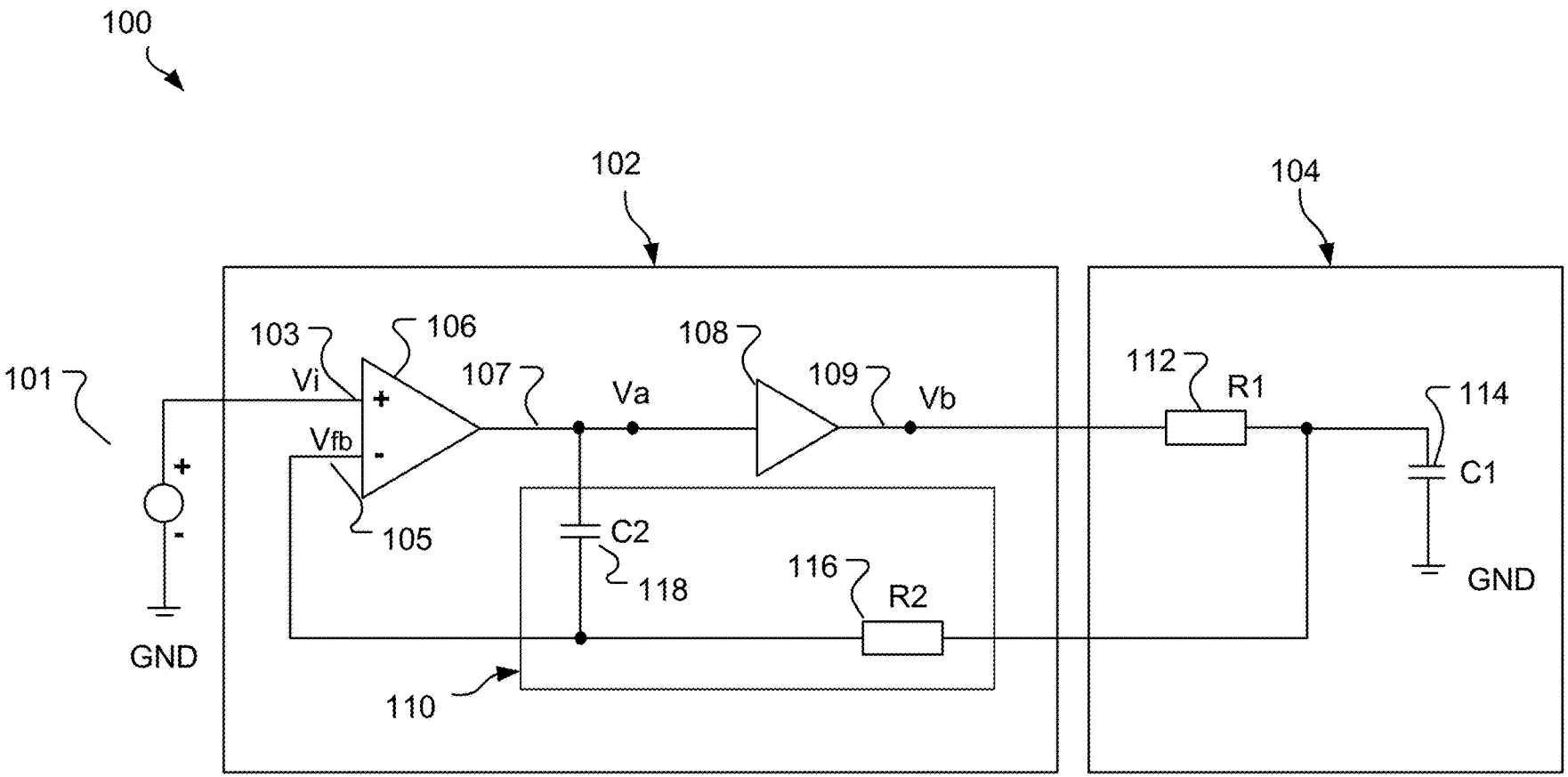
FIG. 1 is a block diagram of an example system including an example regulator with load-insensitive compensation, according to an example embodiment.

FIG. 1 is a block diagram of an example system 100 having an example regulator 102, according to an example implementation. The regulator 102 can be a low-dropout (LDO) regulator. The regulator 102 regulates an input voltage, e.g., from a power supply 101, into a regulated voltage which is supplied to a load 104. The regulator 102 implements a compensation scheme such that the regulator 102 has a substantially unity gain beyond a resonant frequency of the regulator 102, which enables to maintain stable operations over a large range of loading conditions, e.g., orders of magnitude variation in a load capacitance and/or a load resistance.

In some embodiments, the regulator 102 includes an amplifier 106, a follower 108, and a feedback circuit 110.

The amplifier 106 is a differential amplifier and includes a first input 103 for receiving an input voltage $V_i$, a second input 105 for receiving a feedback voltage $V_{fb}$, and an output 107 for outputting an output voltage $V_a$.

In some embodiments, the amplifier 106 is an operational amplifier (or op-amp) that has a high differential-mode gain, a high input impedance, and/or a low output impedance. By applying a negative feedback, an op-amp differential amplifier with predictable and stable gain can be built.

The follower 108 is coupled to the output 107 of the amplifier 106 and responsive to the output voltage $V_a$ of the amplifier 106, and provides a regulated voltage $V_b$ at its output 109. The follower 108 acts as a current source or a current driver. When the received voltage $V_a$ varies, a current through the output 109 varies as well. The follower 108 is a voltage follower and has a gain k (e.g., $k=V_b/V_a$). In some embodiments, the follower 108 has a substantially unity gain, e.g., k=1. The regulator 102 allows the follower 108 to have variations in the gain. The gain k can vary within a range, e.g., +/−5% or 10%.

In some embodiments, the follower 108 includes a transistor. The gate terminal of the transistor is coupled to the output of the amplifier 106 to receive the output voltage Va. The drain terminal (or the source terminal) of the transistor acts as an output node to output the regulated voltage Vb. In one embodiment, the follower 108 is an N-type transistor. In one embodiment, the follower 108 is a bipolar transistor.

The follower 108 supplies the regulated voltage Vb to the load 104. In some embodiments, the load 104 has a load resistance R1 and a load capacitance C1. The load 104 can be represented by an equivalent resistor 112 with the resistance of R1 and an equivalent capacitor 114 with the capacitance of C1. The load 104 is grounded with the capacitor 114 coupled to the ground (GND). The load 104 can have high variability. For example, the load resistance R1 and/or the load capacitance C1 can vary within orders of magnitude, e.g., over time and/or due to significant process, voltage, and temperature (PVT) variations.

The feedback circuit 110 is coupled to the load 104 and the amplifier 106 and provides a feedback voltage $V_{fb}$ to the amplifier 102. Thus, the amplifier 106 forms a close-loop amplifier with feedback. In some embodiments, the feedback circuit 110 includes a resistor 116 with a resistance of R2 and a capacitor 118 with a capacitance of C2. The resistance R2 and the capacitance of C2 can be determined at least partially based on one or more properties of the load 104, e.g., the load resistance R1 and the load capacitance C1.

The resistor 116 is coupled in series with the load 104, e.g., between the resistor 112 and the capacitor 114, to the second input 105 of the amplifier 106. The resistor 116 is coupled in parallel to the capacitor 118. In one embodiment, one end of the capacitor 118 is coupled between the output 107 of the amplifier 106 and the input of the follower 108, and the other end of the capacitor 118 is coupled between the resistor 116 and the second input 105 of the amplifier 106.

In operation, the amplifier 106 functions as a close-loop amplifier and is compensated to have a substantially unity gain beyond a resonant frequency of the amplifier 106, such that the regulator 102 has a stable (or non-oscillatory) operation over a broad range of output capacitive and/or current loading conditions. When the load 104 varies with lower frequencies, e.g., with direct current (DC) loading conditions, instability effects are minimized (or eliminated) by a feedback loop through the resistor 116. The resistance R2 of the resistor 116 can be determined at least partially based on an estimated varying range of the load 104. When the load 104 varies with higher frequencies, e.g., with alternating current (AC) loading conditions, instability effects are minimized (or eliminated) by a feedback loop through the capacitor 118. The capacitance C2 of the capacitor 118 can be determined at least partially based on an estimated varying range of the load 104. In such a way, the regulator 102 can work substantially independently of the loading conditions.

Example Frequency Responses

Figure 2A:
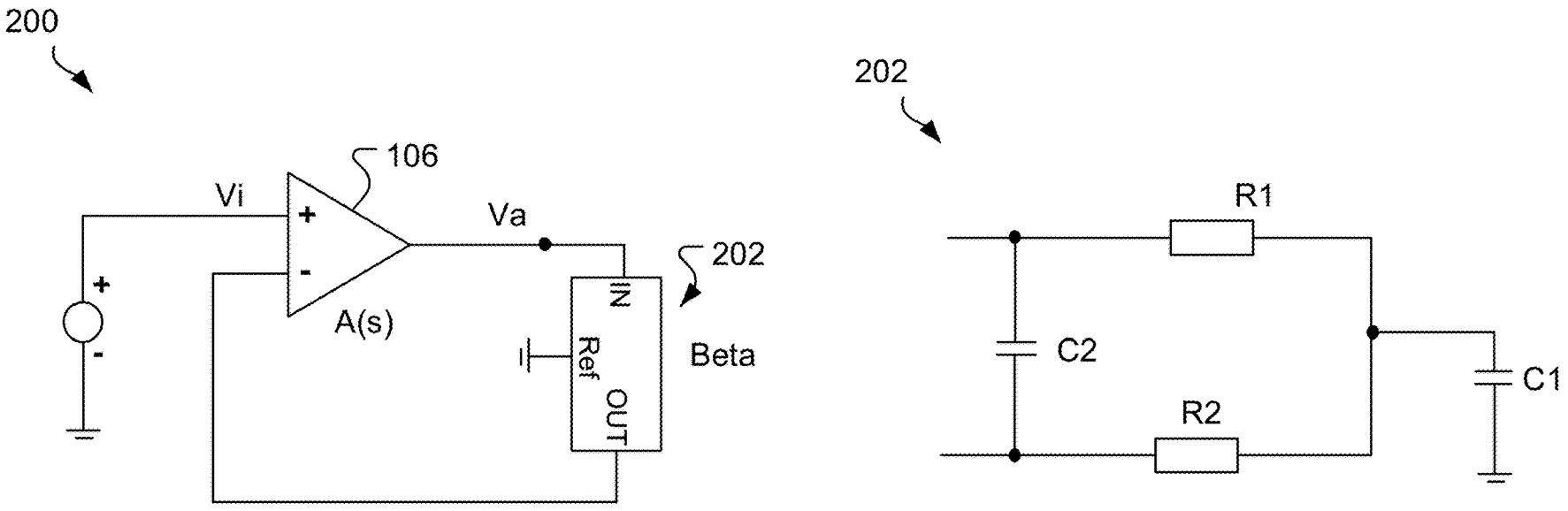
FIG. 2A is a block diagram of a simplified version of the system of FIG. 1, according to an example embodiment.

FIG. 2A is a block diagram of a simplified system 200 of the system 100 of FIG. 1 for stability analysis, according to an example embodiment. The amplifier 106 has a DC gain A. Beta 202 represents a simplified circuit for the follower 108, the feedback circuit 110, and the load 104 of FIG. 1. The beta 202 has a gain β. For simplicity, the follower 108 can be considered to have a unity gain, e.g., k=1. The right figure of FIG. 2A shows a block diagram of the beta 202 with the follower 108 having a unity gain. With k=1, the voltage $V_a=V_b$, and the transfer function of the regulator can be similar to the transfer function of the amplifier.

The gain Ta of the amplifier 106 can be represented by:

$$Ta = \frac{Va}{Vi} = \frac{A}{1+\beta\cdot A} = \frac{d(s)}{\frac{d(s)}{A}+n(s)} \tag{1}$$

where Vi is the voltage at the input of the amplifier 106, Va is the voltage at the input of the follower 108 or the output of the amplifier 106, s is the Laplace complex frequency. For sinusoidal signals, s=jw, $$\beta = n(s)/d(s)$$

$$n(s) = s^2 + \left(\frac{1}{R1C1}+\frac{1}{R2C2}\right)s + \frac{1}{R1C1R2C2},$$

$$d(s) = s^2 + \left(\frac{1}{R1C1}+\frac{1}{R2C1}+\frac{1}{R2C2}\right)s + \frac{1}{R1C1R2C2}.$$

Thus, the gain of the beta 202 can be expressed as:

$$\beta(s) = \frac{s^2+w_nS+w_0^2}{s^2+w_dS+w_0^2} \tag{2}$$

where $w_n=w_1+w_3$, $w_d=w_1+w_2+w_3$, $$w_1 = \frac{1}{R1C1},\ w_2 = \frac{1}{R2C2},\ w_3 = \frac{1}{R2C1},\ w_0 = \sqrt{\frac{1}{R1C1R2C2}}$$

When the gain A is much larger than 1, e.g., when the amplifier 106 is an op-amp, the gain Ta can be expressed as:

$$Ta \cong \frac{d(s)}{n(s)} = \frac{1}{\beta(s)} = \frac{s^2+w_dS+w_0^2}{s^2+w_nS+w_0^2} \tag{3}$$

When $s=w_0$, i.e., at the resonance frequency $w_0$, the gain Ta is represented by:

$$Ta = \frac{w_1 + w_2 + w_3}{w_1 + w_3} > 1 \quad (4)$$

Figure 2B:
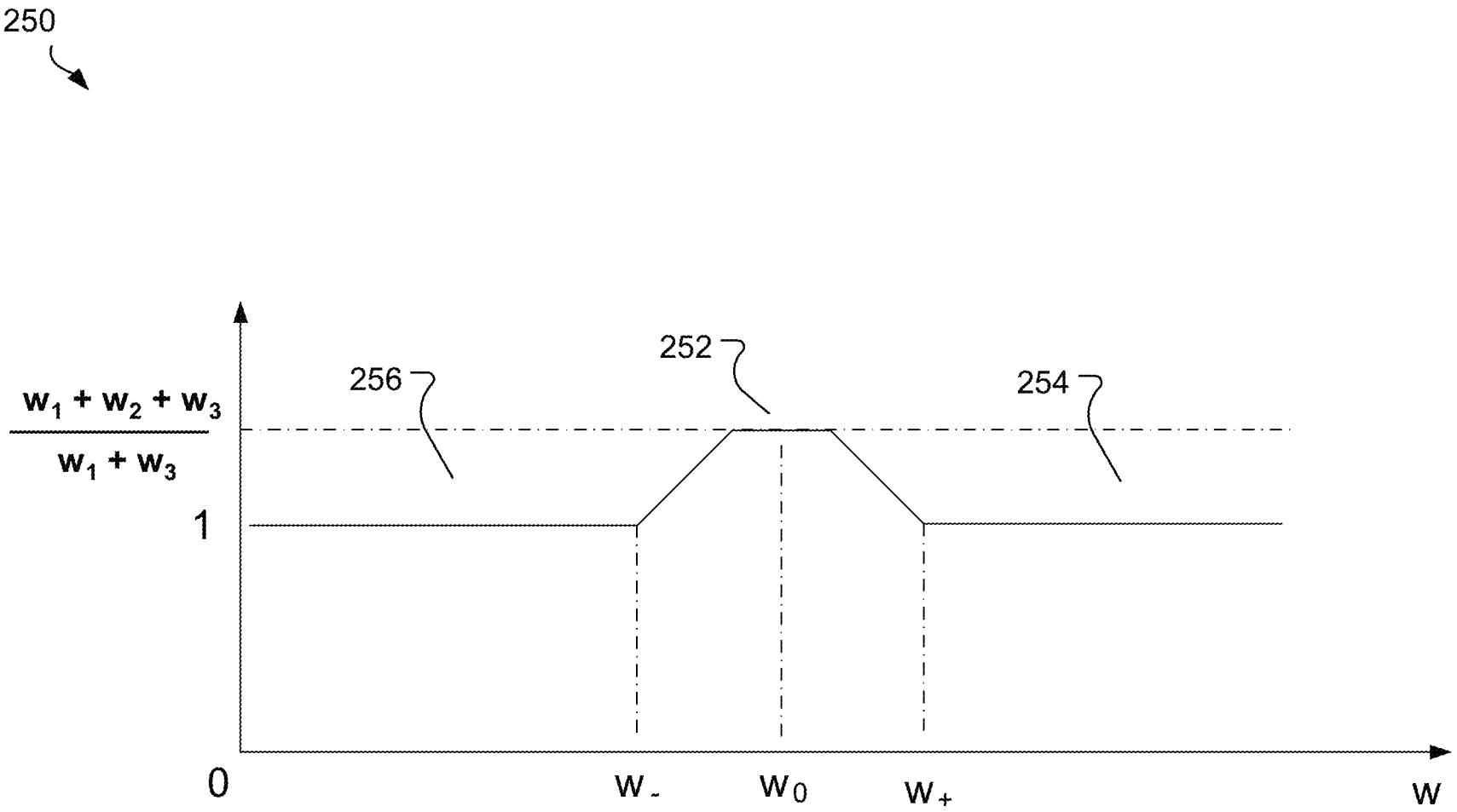
FIG. 2B is a schematic diagram of an example frequency response of the simplified system of FIG. 2A, according to an example embodiment.

FIG. 2B is a schematic diagram of a frequency response profile 250 of the simplified system 200 of FIG. 2A (or the amplifier 106), according to an example embodiment. The frequency response profile 250 has a bump region 252 corresponding to a frequency range from a lower frequency w− to a higher frequency w+. The resonant frequency w0 is within the frequency range, that is, between the lower frequency w− and the higher frequency w+. The bump shape can be symmetrical or asymmetrical. Beyond the frequency range w>w+, the frequency response profile 250 has a stability region 254 which has a substantially unity gain, e.g., Ta=1. In this stability region 254, the system 200 achieves a stable operation over a large range of loading conditions. Within the frequency range, the frequency response gain is larger than the substantially unity gain, e.g., Ta>1. Particularly, at the resonant frequency w0, the gain Ta has a maximum value $$\frac{w_1 + w_2 + w_3}{w_1 + w_3}.$$

the maximum value of the gain Ta can be configured to maintain close to 1 to achieve a better settling and dynamic range for the loading conditions. Below the frequency range w<w−, the frequency response profile 250 also has a stability region 256 with the substantially unity gain.

FIGS. 3A-3F show example frequency responses of the regulator 102 of FIG. 1 having an operational amplifier (op-amp) under different conditions. The amplifier 106 is an op-amp and has a DC gain A0, and the follower 108 has a gain k. The frequency responses are numerically simulated with predetermined exemplary parameters chosen to illustrate characteristic bump behavior, including a load (output) resistance R1=50 kΩ, a load capacitance C1=3.9 nF, a feedback resistance R2=2 MΩ, and a feedback capacitance C2=200 pF. The frequency response curves show close-loop gains Ta (magnitude dB) in the feedback system (e.g., including the regulator 102 and the load 104) versus frequencies f (Hz).

Figure 3A:
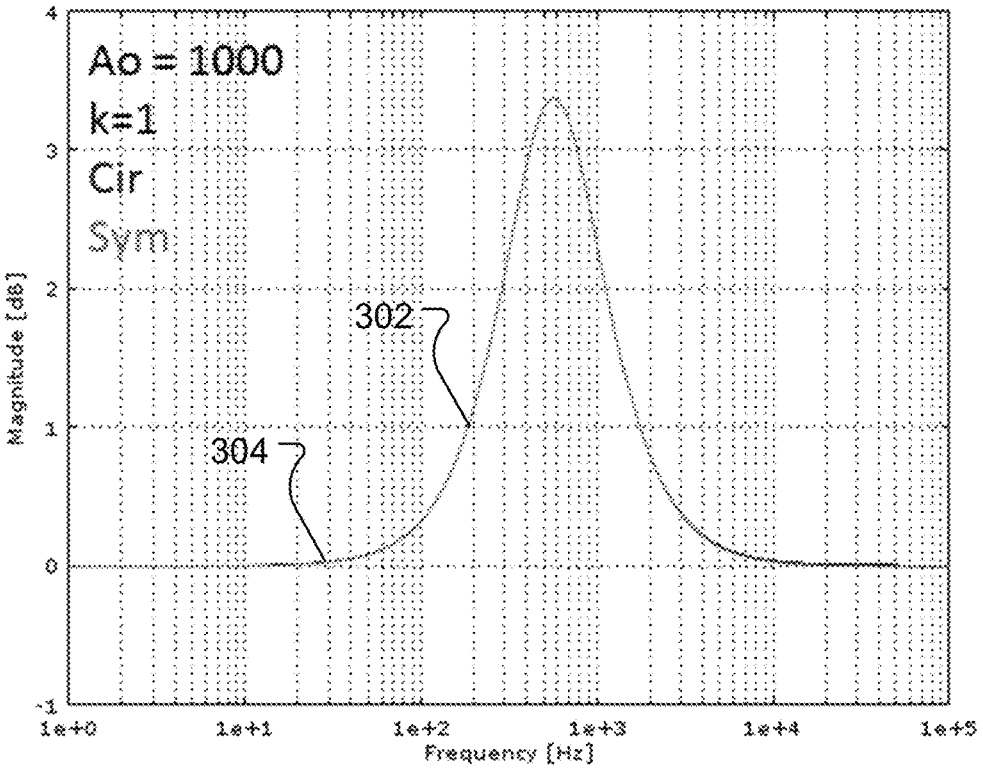
FIG. 3A shows an example frequency response of the example regulator of FIG. 1 having an operational amplifier (op-amp), according to an example embodiment.

FIG. 3A shows the numerical frequency responses using two different simulation methods: Spice circuit analysis (curve 302) and Symbolic simulation (curve 304), when the op-amp is an ideal op-amp with the gain A0 of 1000 and the follower has the unity gain (k=1). Two simulation methods get almost identical frequency responses, confirming analytical expressions. The frequency response curves 302 and 304 have a bump corresponding to a frequency range 10 Hz to 11 kHz. Within the bump, the gain Ta is larger than 1. Beyond the bump (e.g., frequency f>11 kHz), the gain Ta is a substantially unity gain 1.

Figure 3B:
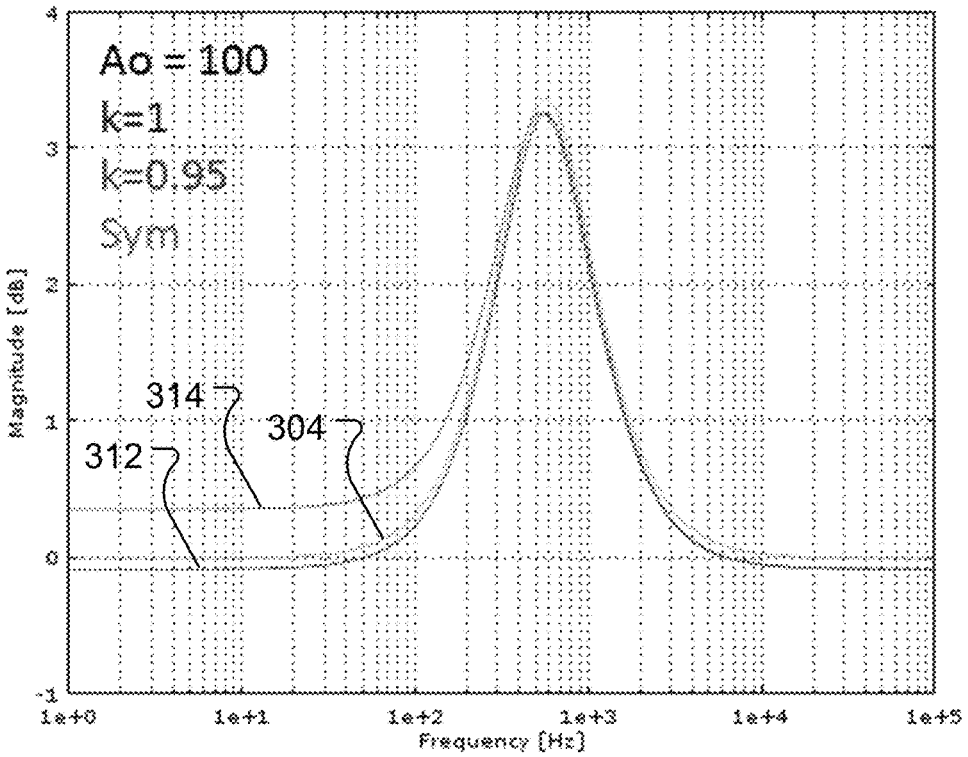
FIG. 3B shows an example frequency response of the example regulator of FIG. 1 having an op-amp with different follower gains, according to an example embodiment.

FIG. 3B shows the numerical frequency responses with different follower gains when the gain A0 is 100. Curve 312 shows the frequency response when k=1, and curve 314 shows the frequency response when k=0.95. Curve 304 is reproduced here where A0 is 1000 and k is 1. The comparison of curves 304 and 312 shows that the DC gain A0 of the amplifier does not affect the frequency response much thus does not affect the stability of the amplifier much. The comparison of curves 312 and 314 indicates that a small variation of the gain of the follower does not affect the frequency response much thus does not affect the stability of the amplifier much.

Figure 3C:
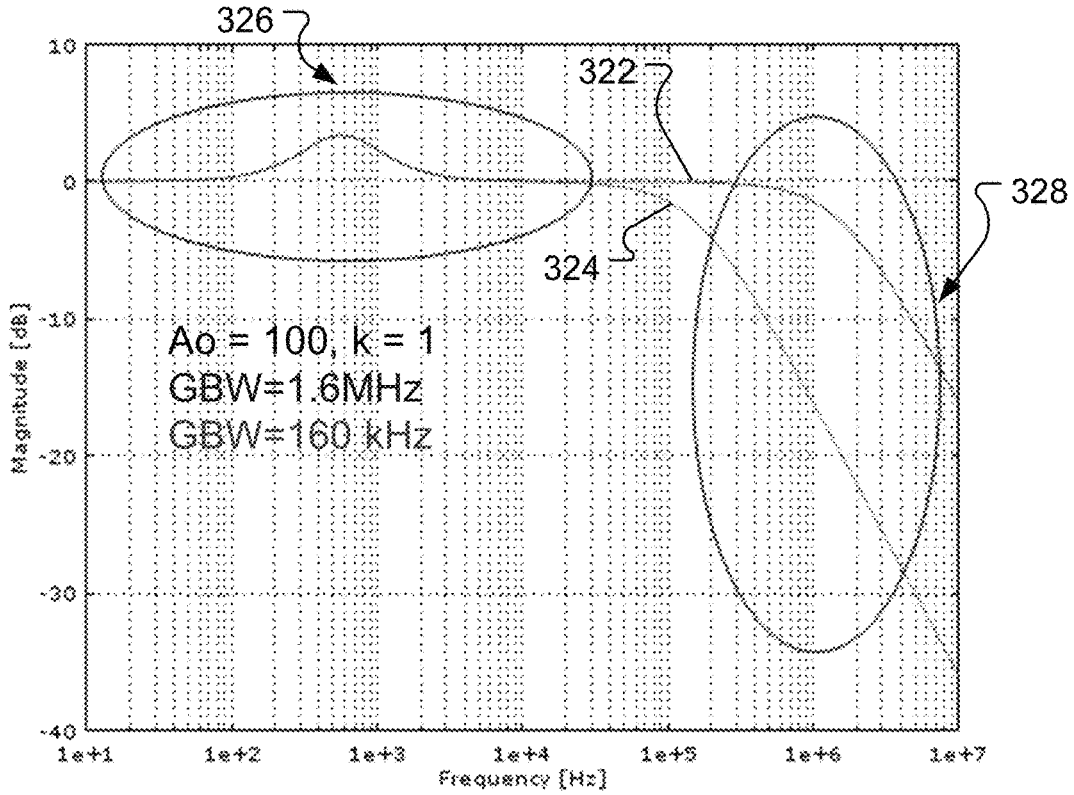
FIG. 3C shows an example frequency response for the example regulator of FIG. 1 having an op-amp with different gain bandwidths, according to an example embodiment.
Figure 3D:
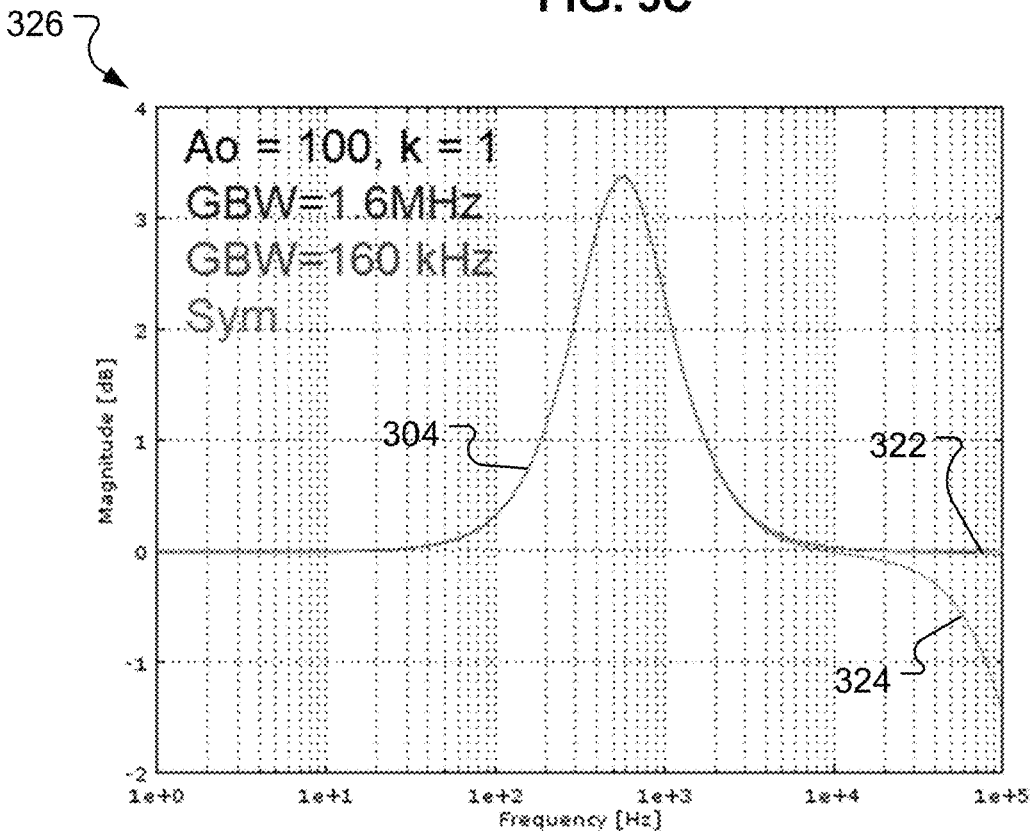
FIG. 3D shows an enlarge portion of the frequency response of FIG. 3C, according to an example embodiment.

FIGS. 3C and 3D shows example frequency responses for the op-amp having different gain bandwidths (GBWs) when A0=100 and k=1. Curve 322 shows the frequency response when GBW is 1.6 MHz and curve 324 shows the frequency response when GBS is 160 kHz. At lower frequencies, curves 322 and 324 have similar profiles 326. At higher frequencies, curves 322 and 324 have different profiles 328, which indicates that the GBW of the op-amp affects the frequency response of the op-amp with compensation at high frequencies. Curve 324 shows the op-amp works like a low-pass filter when the GBW is lower. FIG. 3D shows an enlarged portion of the frequency responses of FIG. 3C at lower frequencies. For comparison, curve 304 is reproduced here where A0 is 1000 and k is 1. Curves 304, 322 and 324 have similar profiles with a bump including the resonant frequency.

Figure 3E:
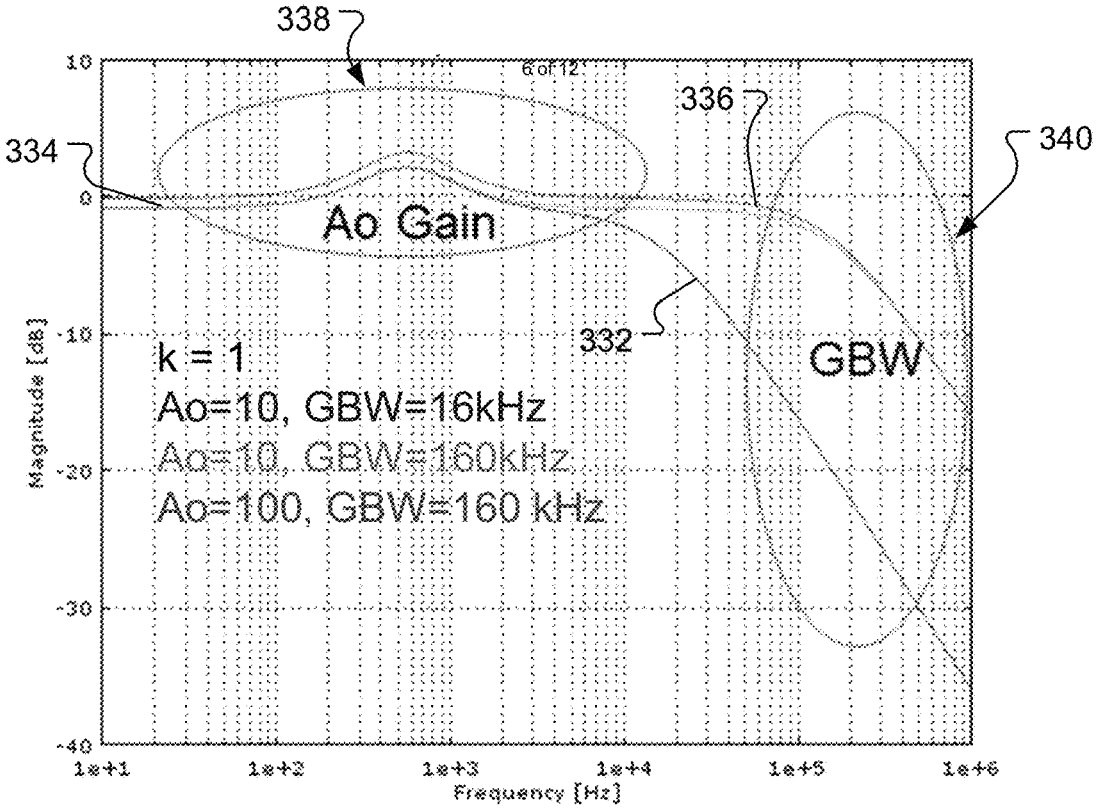
FIG. 3E shows an example frequency response for the example regulator of FIG. 1 having an op-amp with different gain bandwidths and DC gains, according to an example embodiment.
Figure 3F:
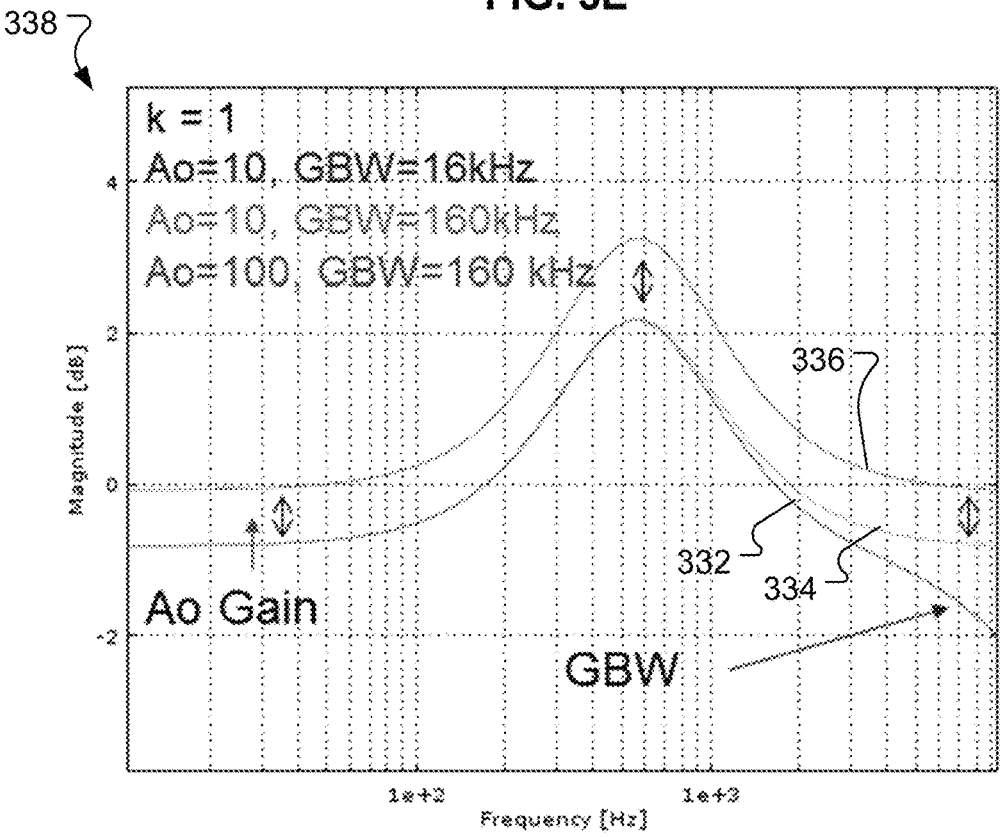
FIG. 3F shows an enlarge portion of the frequency response of FIG. 3E, according to an example embodiment.

FIGS. 3E and 3F shows example frequency responses for the op-amp having different gain bandwidths and DC gains when k=1. Curve 332 shows the frequency response when A0=10 and GBW=16 kHz, curve 334 shows the frequency response when A0=10 and GBW=160 kHz, and curve 336 shows the frequency response when A0=100 and GBW=160 kHz. FIG. 3F shows an enlarged portion of the frequency responses of FIG. 3E. These curves show that, at lower frequencies, the DC gain of the op-amp has more significant effect on the frequency response than the GBW of the op-amp; while at higher frequencies, whereby the overall close-loop system stability matters, the GBW of the op-amp has more significant effect on the frequency response than the DC gain. The larger the op-amp DC gain, the closer to unity the close-loop system gain is. Note that non-ideal op-amps with much differing DC gains A0 but with same GBWs behave similarly at high frequencies whereby the feedback loop stability matters and is the subject of this analysis.

To perform detailed analysis of close-loop stability for a non-ideal op-amp in the regulator of FIG. 1, Routh-Hurwitz Criteria (RHC) is used, where algebraic conditions are based on system characteristic polynomial coefficients.

Equation (1) shows that the close-loop gain Ta(s) is expressed by:

$$Ta(s) = \frac{d(s)}{d(s)/A(s) + n(s)}, \quad (5)$$

where a generic two-pole non-ideal op-amps has $$A(s) = \frac{A_0 w_1 w_2}{s(s + w_2)} = \frac{Bw_2}{s(s + w_2)}$$

when w>>w1, $B=A_0w_1-GBW$, w1 is the first pole, $w_2$ is the $2^{nd}$ pole and $w_2=m*B$, where m is the op-amp design parameter.

The system characteristic polynomial coefficients can be expressed by:

$$D(s)=s^4+a_1s^3+a_2s^2+a_3s+a_4 \quad (6),$$

where $a_1=w_d+w_2=w_d+mB$, $a_2=w_0^2+w_2w_d+Bw_2=w_0^2+mB^2+w_dmB$, $a_3=w_2w_0^2+Bw_2w_n=w_0^2mB+w_nmB^2$, $a_4=Bw_2w_0^2=w_0^2mB^2$.

For overall system stability, the RHC (or the polynomial coefficients) should satisfy the following condition:

$$RHC = \frac{a_1 a_2 a_3}{a_3^2 + a_1^2 a_4} > 1. \quad (7)$$

Thus, the resulting op-amp and RC conditions can be expressed as:

$$m > \frac{w_n^2}{Bw_n - w_0^2}. \quad (8)$$

Figure 4A:
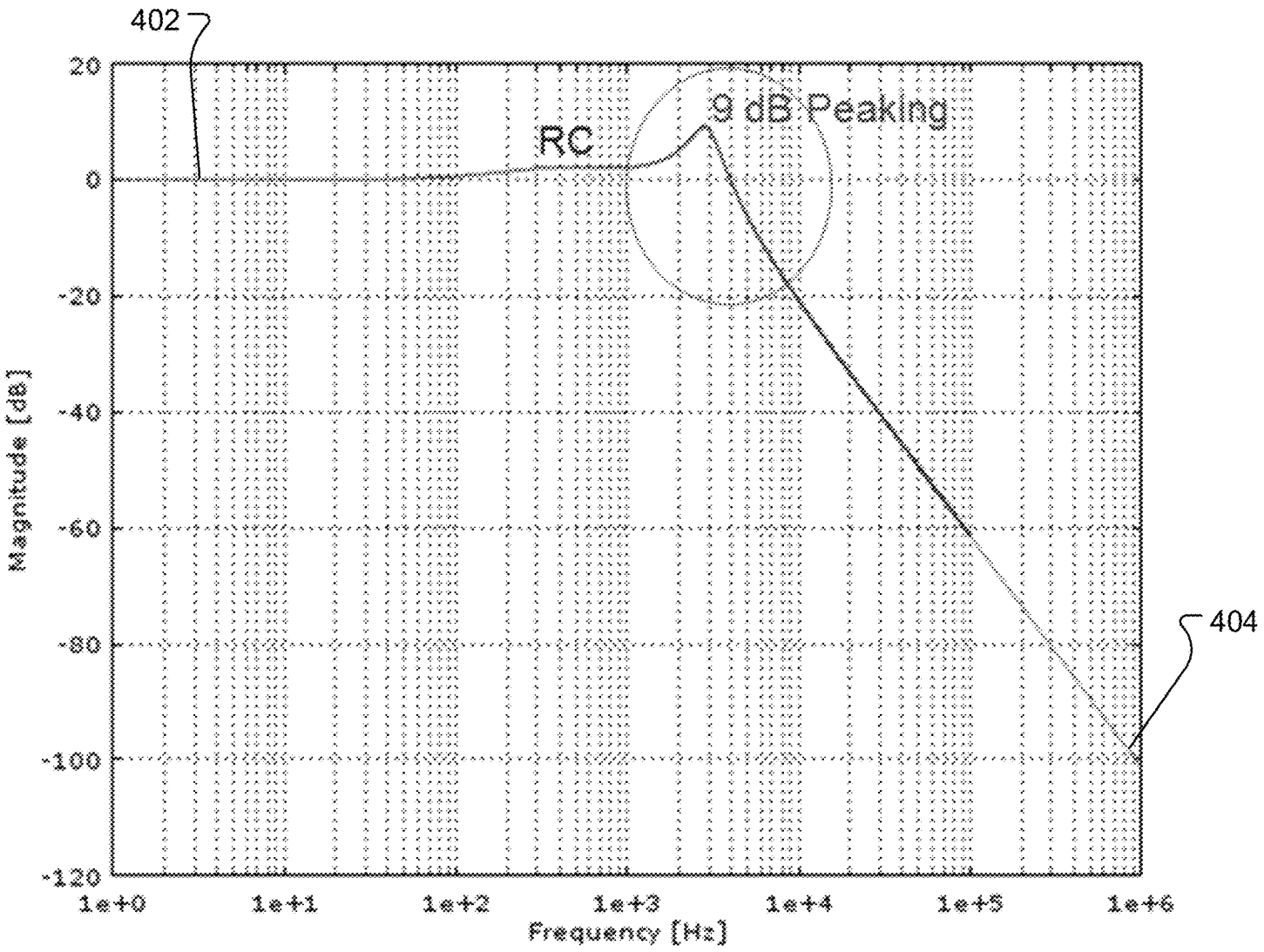
FIG. 4A shows an example frequency response of the example regulator of FIG. 1 having a non-ideal op-amp with a low Routh-Hurwitz Criteria (RHC) value, according to an example embodiment.
Figure 4C:
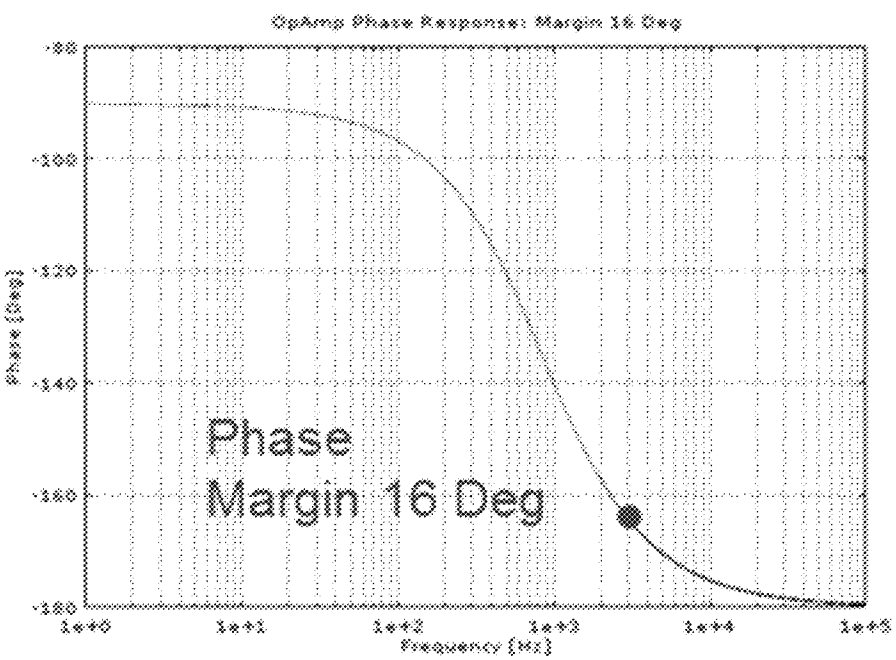
FIG. 4C shows an example phase response in phase of the non-ideal op-amp of FIG. 4A, according to an example embodiment.
Figure 4B:
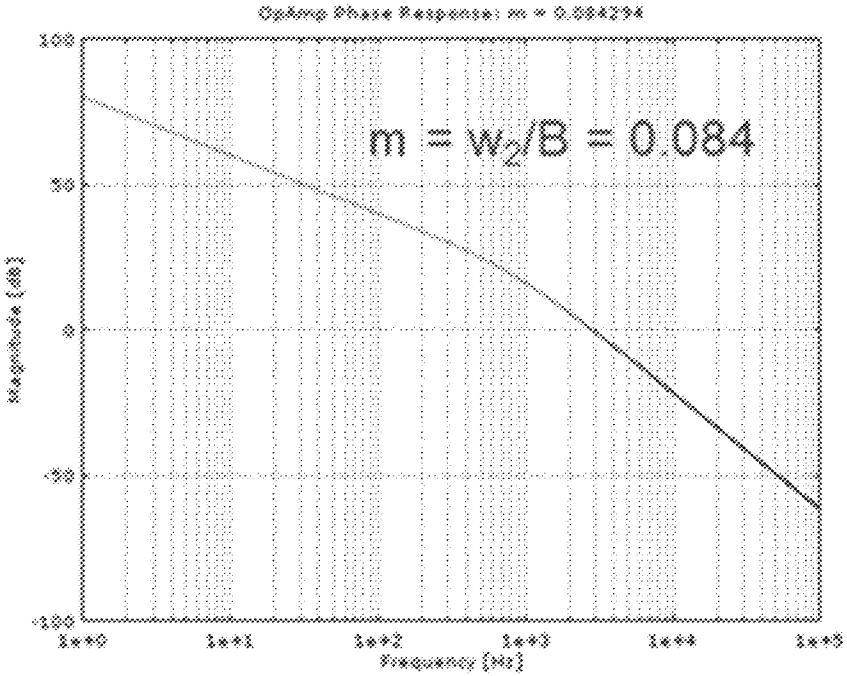
FIG. 4B shows an example phase response in magnitude of the non-ideal op-amp of FIG. 4A, according to an example embodiment.

FIG. 4A shows an example frequency response of the regulator 102 having a non-ideal op-amp with a low Routh-Hurwitz Criteria (RHC) value. The stability condition is just satisfied with RHC ~2.2. Curves 402 and 404 show the frequency responses using Matlab simulation and Spice circuit analysis, respectively indicating agreement with analytic expressions. These curves show 9 dB peaking, which indicates that the feedback loop system is stable but possess high-Q complex poles and thus is not practical. FIG. 4B shows an example response in magnitude (dB) of the corresponding non-ideal op-amp of FIG. 4A, having a low design parameter m ~0.084. FIG. 4C shows an example phase response in phase (degree) of the non-ideal op-amp of FIG. 4A. At the peak of the curves (see FIG. 4A), the phase margin is only 16 degrees.

Figure 4D:
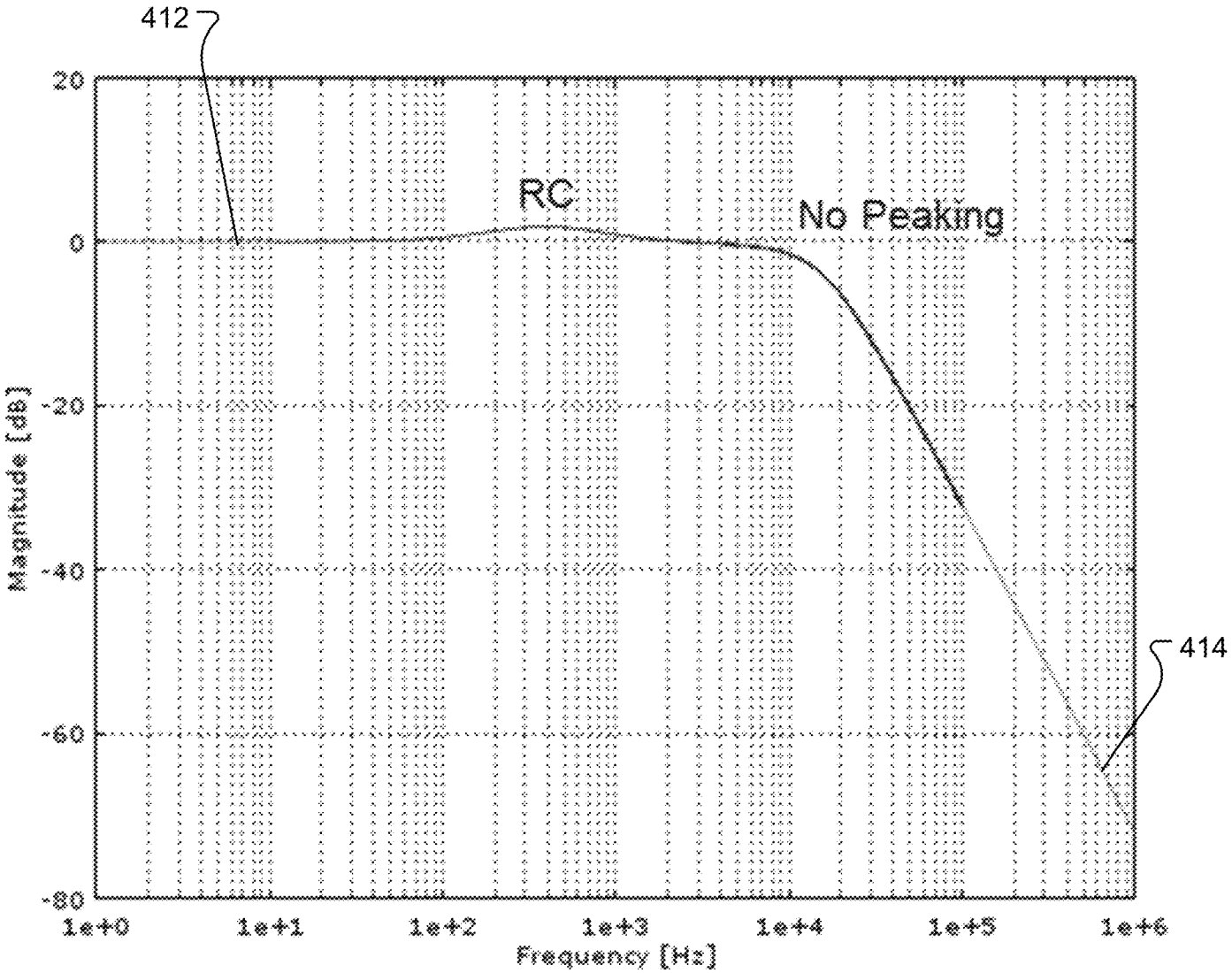
FIG. 4D shows an example frequency response for the example regulator of FIG. 1 having a non-ideal op-amp with a high RHC value, according to an example embodiment.
Figure 4F:
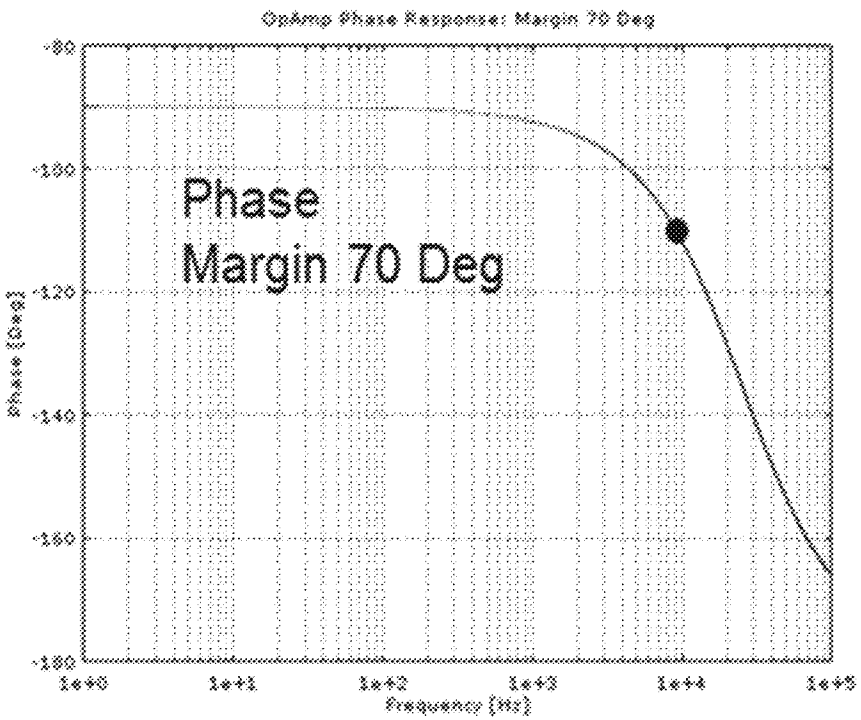
FIG. 4F shows an example phase response in phase of the non-ideal op-amp of FIG. 4D, according to an example embodiment.
Figure 4E:
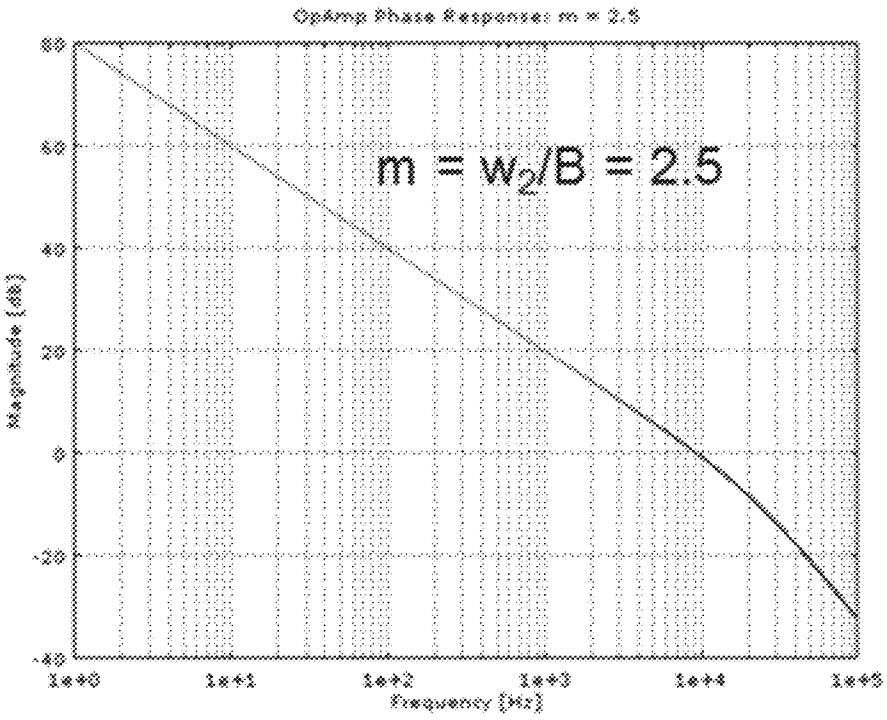
FIG. 4E shows an example phase response in magnitude of the non-ideal op-amp of FIG. 4D, according to an example embodiment.

On the other hand, FIG. 4D shows an example frequency response of the regulator 102 having a non-ideal op-amp purposely designed for unity-gain operation with m=2.5 consequently resulting in greater RHC value. Here the RHC is more strictly obeyed with a value of 22. Curves 412 and 414 show the frequency responses using Matlab simulation and Spice circuit analysis, respectively. These curves show that there is a bump region at lower frequencies corresponding to the chosen RC-values and no peaking observed at higher frequencies, indicating robust loop stability. FIG. 4E shows the response in magnitude (dB) of the non-ideal op-amp of FIG. 4D, with m=2.5. FIG. 4F shows the phase response in phase (degrees). The phase margin of the op-amp self phase response is 70 degrees—typical of an op-amp design. Thus, to achieve overall feedback loop stability, the op-amp used in the system is necessary and sufficient to be designed for unity-gain stable operation itself—irrespective of the rest (or remaining) parameter values or their variations in the system.

Example Compensation Systems

Figure 5:
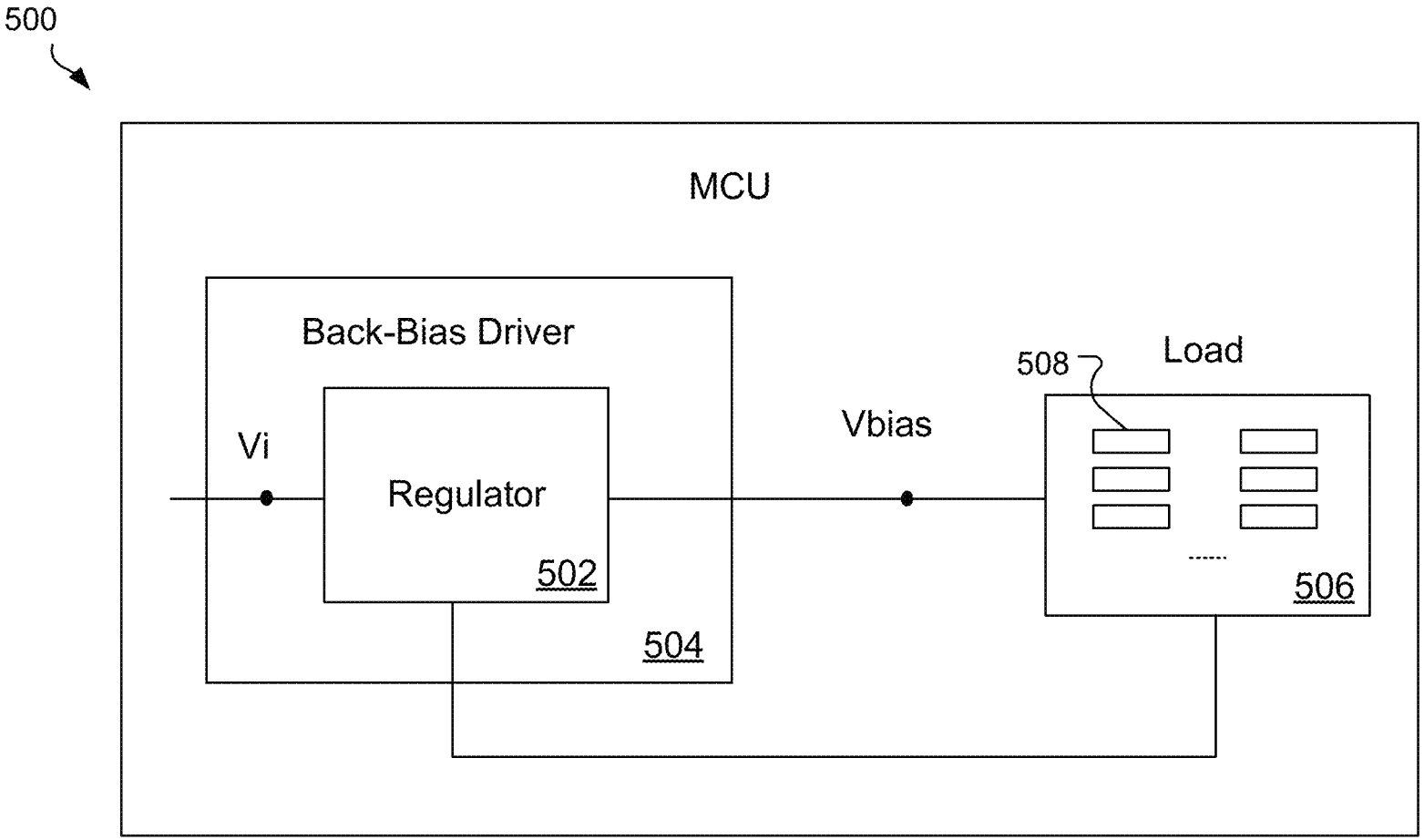
FIG. 5 is a block diagram of an example system including a regulator with load-insensitive compensation, according to an example embodiment.

FIG. 5 is a block diagram of an example system 500 including a regulator 502 with load-insensitive compensation, according to an example embodiment. The system 500 can be a microcontroller (MCU) chip that includes a back-bias driver 504 and a load 506. The back-bias driver 504 is configured to receive a voltage $V_i$, e.g., from a power supply in the MCU 500, and supply a bias voltage $V_{bias}$ to the load 506. The back-bias driver 504 includes the regulator 502 to regulate voltage $V_i$ to $V_{bias}$, such that the supplied voltage $V_{bias}$ maintains stable over a large range of loading conditions of the load 506. The regulator 502 can be similar to the regulator 102 of FIG. 1.

In some embodiments, the load 506 includes a number of cells (e.g., gates) 508. The cells have well-tap placements in the MCU chip. The MCU 500 can have a large chip area. In one embodiment, the number of the cells is approximate 260 k, and the number of well-taps is approximate 9266, where each well tap includes 27 average cells. The well-taps are placed in a checkerboard pattern, and the distance between the well-taps are about 75 μm in single row, and 40 μm in alternate row. The loading conditions of the load 506 can vary significantly.

The MCU 500 can have a digital cord that includes the end wells of the cells 508. The cord can be divided into two kinds of domains. The first domain can be turned off when the MCU 500 is in a power down (or standby) mode, and the second domain is where there may have some particular hertz block activity and/or some logic switching happening in the power down mode. The logic switching may happen at every clock cycle. Thus, some parts of the MCU 500 may be partially activated, which adds to variability of the load 506 in a wide range. A temperature of the MCU chip may also affect the load conditions, e.g., a load capacitance or load current. The temperature of the MCU chip can vary from −40 to 125° C. The load capacitance can vary from 0.09 nF to 4 nF. The load current can vary from 0.05 μA to 15 μA. In one embodiment, when the temperature is at −40° C., the load current is 0.05 μA, within 10 nA range, and when the temperature increases to 125° C., the load current increases to 15 μA.

The back-bias driver 504 is configured to reduce power consumption when the MCU 500 is in the power down (or standby) mode. The power the MCU 500 consumes during the power down mode largely comes from a leakage current, which is determined by the temperature of the MCU chip and/or the number of active cells. By providing a low power supply (low bias voltage), the back-bias driver 504 enables to reduce the total leakage current of the MCU chip and thus to save chip leakage consumption, e.g., by 70%. The regulator 502 is configured with load-insensitive compensations so as to provide a stable bias voltage $V_{bias}$ independently of the varying loading conditions. In one embodiment, the back-bias driver 504 having the regulator 502 enables to get quiescent current consumption of less than 200 nA at 25° C.

Example Flowchart

Figure 6:
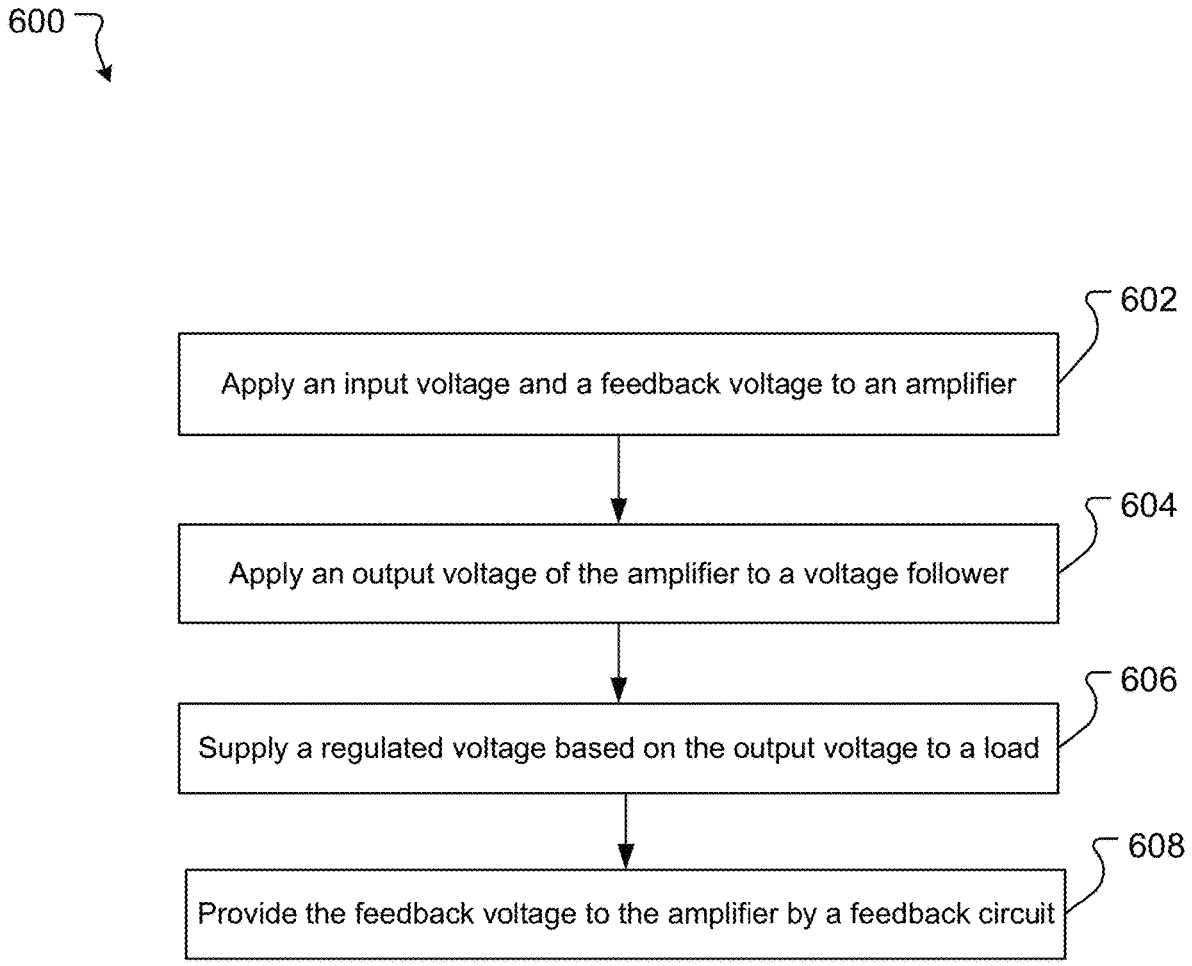
FIG. 6 is a flow diagram of an example process of performing load-insensitive compensation for a regulator, according to an example embodiment.

FIG. 6 is a flow diagram of an example process 600 of performing load-insensitive compensation for a regulator, according to an example embodiment. The process 600 is performed by the regulator. The regulator can be the regulator 102 of FIG. 1 or the regulator 502 of FIG. 5. In some embodiments, the regulator includes an amplifier, a follower, and a feedback circuit. The amplifier, the follower, and the feedback circuit can be similar to the amplifier 106, the follower 108, and the feedback circuit 110 of FIG. 1.

The regulator applies an input voltage and a feedback voltage to the amplifier (602). For example, the amplifier includes a first input for receiving the input voltage, e.g., from a power supply, and a second input for receiving a feedback voltage from the feedback circuit. The amplifier also includes an output for outputting an output voltage. In some embodiments, the amplifier is an operational amplifier, particularly with a large DC gain, e.g., over 100, and/or a large gain bandwidth, e.g., more than 100 kHz.

The output voltage of the amplifier is applied to the follower (604). An input of the follower is coupled to the output of the amplifier to receive the output voltage. In some embodiments, the follower is a transistor, and the gate terminal of the transistor is responsive to the output voltage of the amplifier. The follower is configured to have a substantially unity gain.

The follower outputs a regulated voltage to a load coupled to the follower (606). The regulated voltage is based on the output voltage of the amplifier. When the follower has a substantially unity gain, the regulated voltage has a substantially same amplitude as the output voltage. The load can be similar to the load 104 of FIG. 1 or the load 506 of FIG. 5. As noted above, the load can have a load resistance and/or a load capacitance, which can vary significantly within a large range, e.g., over a few orders of magnitude.

The regulator provides the feedback voltage to the amplifier by the feedback circuit that is coupled to the load and the amplifier (608). In some embodiments, the feedback circuit includes a capacitor coupled between the second input and the output of the amplifier and a resistor coupled in series with the load to the output of the amplifier. The resistor is coupled in series with the load, and coupled in parallel to the capacitor to the output of the amplifier. The capacitance of the capacitor and the resistance of the resistor in the feedback circuit can be determined at least partially based on one or more properties of the load, e.g., a varying range of the load resistance and/or the load capacitance.

With the feedback loop, the amplifier works as a close-loop amplifier and is configured to have a substantially unity gain beyond a resonant frequency of the amplifier. In some embodiments, the amplifier has a frequency response profile having a bump corresponding to a frequency range around the resonant frequency. The amplifier has a close-loop gain larger than the substantially unity gain in the frequency range and the substantially unity gain beyond the frequency range. The amplifier is configured such that the amplifier maintains the substantially unity gain when the load capacitance and/or the load resistance varies over more than an order of magnitude.

In some embodiments, the regulator is implemented with different compensation schemes. For example, the load may include a load inductance. The feedback circuit can be configured to include an inductor (L). The feedback circuit can include any suitable combinations of resistors (R) and capacitors (C), CL, or RCL. The feedback circuit can also include one or more resistors, one or more capacitors, and/or one or more inductors. These resistors, capacitors, and/or inductors can have suitable configurations in the feedback circuit.

Example Concepts

In view of the foregoing, it is noted that the present technology may be implemented, for example, in accordance with the following example concepts:

1. A voltage regulator includes an amplifier having a first input for receiving an input voltage, a second input for receiving a feedback voltage, and an output for providing an output voltage; a follower having a first terminal responsive to the output voltage and a second terminal for supplying a regulated voltage to a load coupled to the follower; and a feedback circuit including: a capacitor coupled between the second input and the output of the amplifier, and a resistor coupled in series with the load to the output of the amplifier, wherein the feedback circuit is operable to provide the feedback voltage.

2. The voltage regulator of Concept 1, where the amplifier is operable to be a close-loop amplifier with a frequency response profile having a bump corresponding to a frequency range around a resonant frequency of the close-loop amplifier, and the close-loop amplifier has a substantially unity gain beyond the frequency range and a gain larger than the substantially unity gain within the frequency range.

3. The voltage regulator of Concept 2, where the amplifier maintains the substantially unity gain when a load capacitance or resistance of the load varies over more than an order of magnitude.

4. The voltage regulator of Concept 1, where the amplifier includes an operational amplifier with a gain higher than 100 and a gain bandwidth larger than 100 kHz, and the follower includes a transistor having a substantially unity gain.

It is noted that the foregoing example concepts are presented for purposes of illustration, and that the present technology is not limited to these example concepts.

Particular embodiments of the subject matter described in this specification can be implemented so as to realize one or more of the following advantages. This technology can be applied for regulators (or amplifiers with feedback) operable to maintain stable operations over a large range of loading conditions and/or significant process, voltage, and temperature (PVT) variations, e.g., a few orders of magnitude variation in a load capacitance (e.g., over time) and/or an output current over a broad temperature range. The regulators can also have low quiescent consumption. The regulators employ no special means for feedback loop pole-zero variation tracking. In other words, the regulators have load-insensitive compensations, where the loop stability is guaranteed mostly irrespective of the outside operating regime and conditions. This technology enables a wide use of techniques/methodologies for ultra low power designs, including back-bias drivers that has considerable capacitive/current load capability and very low quiescent power. The regulators can be entirely on-chip with no external components and enables to achieve an integrated and/or miniature system, e.g., a microcontroller (MCU).

While this specification contains many specific implementation details, these should not be construed as limitations on the scope of any invention or on the scope of what may be claimed, but rather as descriptions of features that may be specific to particular embodiments of particular inventions. Certain features that are described in this specification in the context of separate embodiments can also be implemented in combination in a single embodiment. Conversely, various features that are described in the context of a single embodiment can also be implemented in multiple embodiments separately or in any suitable subcombination. Moreover, although features may be described above as acting in certain combinations and even initially claimed as such, one or more features from a claimed combination can in one example implementation be excised from the combination, and the claimed combination may be directed to a subcombination or variation of a subcombination.

Similarly, while operations are depicted in the drawings in a particular order, this should not be understood as requiring that such operations be performed in the particular order shown or in sequential order, or that all illustrated operations be performed, to achieve desirable results. In certain circumstances, multitasking and parallel processing may be advantageous. Moreover, the separation of various system modules and components in the embodiments described above should not be understood as requiring such separation in all embodiments, and it should be understood that the described program components and systems can generally be integrated together in a single software product or packaged into multiple software products.

Thus, particular embodiments of the subject matter have been described. Other embodiments are within the scope of the following claims. In one example implementation, the actions recited in the claims can be performed in a different order and still achieve desirable results. In addition, the processes depicted in the accompanying figures do not necessarily require the particular order shown, or sequential order, to achieve desirable results. In certain implementations, multitasking and parallel processing can be advantageous.

What is claimed is:

1. A device comprising:

an amplifier operable to receive an input voltage at a first input and a feedback voltage at a second input;

a follower responsive to an output voltage of the amplifier from an output of the amplifier and operable to supply a regulated voltage to a load that is coupled to the follower and grounded to a ground; and a feedback circuit coupled to the load and the amplifier and operable to provide the feedback voltage, wherein the feedback circuit comprises:

a capacitor coupled between the output of the amplifier and the second input of the amplifier, and a resistor having a first end coupled within the load and between an output of the follower and the ground and a second end coupled to the second input of the amplifier, and wherein a capacitance of the capacitor and a resistance of the resistor are configured at least partially based on an estimated varying range of the load, such that the amplifier is operable to have a stable and substantially unity gain beyond a resonant frequency of the amplifier.

2. The device of claim 1, wherein the amplifier is operable to have a frequency response profile with a bump shape corresponding to a frequency range around the resonant frequency, and wherein the amplifier has a gain larger than the substantially unity gain within the frequency range and the substantially unity gain beyond the frequency range.

3. The device of claim 1, wherein the amplifier maintains the substantially unity gain when a load capacitance or resistance of the load varies over more than an order of magnitude.

4. The device of claim 1, wherein the capacitance of the capacitor and the resistance of the resistor are determined at least partially based on one or more properties of the load a varying range of a load capacitance or resistance of the load.

5. The device of claim 1, wherein the amplifier has a direct current (DC) gain more than 100 and a gain bandwidth larger than 100 kHz.

6. The device of claim 1, wherein the amplifier comprises an operational amplifier.

7. The device of claim 1, wherein the follower is operable to have a substantially unity gain.

8. The device of claim 1, wherein the follower comprises a transistor.

9. The device of claim 1, wherein the load is representable by an equivalent resistor and an equivalent capacitor coupled in series between an output of the follower and the ground, the load being coupled to the output of the follower through the equivalent resistor and to the ground through the equivalent capacitor.

10. The device of claim 9, wherein the first end of the resistor is coupled between the equivalent resistor and the equivalent capacitor of the load, and wherein the resistor is coupled in series with the equivalent capacitor between the ground and the second input of the amplifier and coupled in series with the equivalent resistor between the output of the follower and the second input of the amplifier.

11. The device of claim 1, wherein the feedback circuit is configured to:

reduce through resistor instability caused by the load varying with one or more direct current (DC) loading conditions, and reduce through capacitor instability caused by the load varying with one or more alternating current (AC) loading conditions.

12. A system comprising:

a voltage regulator having:

an amplifier operable to receive an input voltage at a first input and a feedback voltage at a second input;

a follower responsive to an output voltage of the amplifier at an output of the amplifier and operable to supply a regulated voltage to a load that is coupled to the follower and grounded to a ground; and a feedback circuit coupled to the load and the amplifier and operable to provide the feedback voltage, wherein the feedback circuit comprises:

a capacitor coupled between the output of the amplifier and the second input of the amplifier, and a resistor having a first end coupled within the load and between an output of the follower and the ground and a second end coupled to the second input of the amplifier, and wherein a capacitance of the capacitor and a resistance of the resistor are configured at least partially based on an estimated varying range of the load, such that the amplifier is operable to have a stable and substantially unity gain beyond a resonant frequency of the amplifier and the voltage regulator is operable to work substantially independently of a loading condition of the load.

13. The system of claim 12, comprising a back-bias driver of a microcontroller that includes the voltage regulator.

14. The system of claim 12, wherein the amplifier has a frequency response profile with a bump shape corresponding to a frequency range around the resonant frequency, and wherein the amplifier has a gain larger than the substantially unity gain within the frequency range and the substantially unity gain beyond the frequency range.

15. The system of claim 12, wherein the amplifier maintains the substantially unity gain when a load capacitance or resistance of the load varies over more than an order of magnitude.

16. The system of claim 12, wherein the follower is operable to have a substantially unity gain.

17. A method comprising:

applying an input voltage to a first input of an amplifier and a feedback voltage to a second input of the amplifier;

applying an output voltage of the amplifier from an output of the amplifier to a follower;

supplying a regulated voltage by the follower to a load that is coupled to the follower and grounded to a ground, the regulated voltage being based on the output voltage;

providing, by a feedback circuit coupled to the load and the amplifier, the feedback voltage to the amplifier, wherein the feedback circuit comprises:

a capacitor coupled between the output of the amplifier and the second input of the amplifier, and a resistor having a first end coupled within the load and between an output of the follower and the ground and a second end coupled to the second input of the amplifier, and wherein a capacitance of the capacitor and a resistance of the resistor are configured at least partially based on an estimated varying range of the load, such that the amplifier has a stable and substantially unity gain beyond a resonant frequency of the amplifier.

18. The method of claim 17, wherein the amplifier has a frequency response profile with a bump shape corresponding to a frequency range around the resonant frequency, and wherein the amplifier has a gain larger than the substantially unity gain within the frequency range and the substantially unity gain beyond the frequency range.

19. The method of claim 17, wherein the amplifier maintains the substantially unity gain when a load capacitance or resistance of the load varies over more than an order of magnitude.

20. The method of claim 17, wherein the follower comprises a transistor operable to have a substantially unity gain.

* * * * *